US007954808B2

(12) United States Patent
Tomida

(10) Patent No.: US 7,954,808 B2
(45) Date of Patent: Jun. 7, 2011

(54) SHEET PROCESSING DEVICE, IMAGE FORMING APPARATUS, AND IMAGE FORMING SYSTEM

(75) Inventor: Hirofumi Tomida, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 12/461,785

(22) Filed: Aug. 25, 2009

(65) Prior Publication Data

US 2010/0044958 A1 Feb. 25, 2010

(30) Foreign Application Priority Data

Aug. 25, 2008 (JP) ..... 2008-215029
May 20, 2009 (JP) ..... 2009-121943

(51) Int. Cl.
*B65H 31/00* (2006.01)
*B65H 31/36* (2006.01)

(52) U.S. Cl. ..... 271/207; 271/221; 270/58.01

(58) Field of Classification Search ..... 271/207, 271/221, 223, 224; 270/58.01
See application file for complete search history.

(56) References Cited

U.S. PATENT DOCUMENTS

| | | | | |
|---|---|---|---|---|
| 5,906,367 | A * | 5/1999 | Takagaki | 271/218 |
| 6,126,163 | A * | 10/2000 | Katsuta et al. | 271/223 |
| 6,505,830 | B2 * | 1/2003 | Kang | 271/223 |
| 6,889,974 | B2 | 5/2005 | Tamura et al. | |
| 7,182,333 | B2 | 2/2007 | Tamura et al. | |
| 7,380,786 | B2 | 6/2008 | Tamura et al. | |
| 7,441,771 | B2 | 10/2008 | Tamura et al. | |
| 7,451,980 | B2 | 11/2008 | Tamura et al. | |
| 7,762,546 | B2 * | 7/2010 | Wakakusa et al. | 271/207 |
| 2009/0218746 | A1 | 9/2009 | Matsuura | |
| 2009/0236798 | A1 * | 9/2009 | Kimura et al. | 271/221 |

FOREIGN PATENT DOCUMENTS

| | | |
|---|---|---|
| JP | 2003-312930 | 11/2003 |
| JP | 3973836 | 6/2007 |

OTHER PUBLICATIONS

Abstract of JP 2002-179326 published on Jun. 26, 2002.

* cited by examiner

*Primary Examiner* — Kaitlin S Joerger
(74) *Attorney, Agent, or Firm* — Harness, Dickey & Pierce, P.L.C.

(57) ABSTRACT

A shifting unit shifts a plurality of sheets discharged on a tray to a different position in a sheet width direction that is perpendicular to a sheet discharging direction in a set of sheets. A first width-direction aligning unit and a second width-direction aligning unit align both sides of the sheets in the sheet width direction. A leading-edge aligning unit aligns leading edges of the sheets in the sheet discharging direction.

13 Claims, 7 Drawing Sheets

SHEET PROCESSING DEVICE, IMAGE FORMING APPARATUS, AND IMAGE FORMING SYSTEM

CROSS-REFERENCE TO RELATED APPLICATIONS

The present application claims priority to and incorporates by reference the entire contents of Japanese Patent Application No. 2008-215029 filed in Japan on Aug. 25, 2008 and Japanese Patent Application No. 2009-121943 filed in Japan on May 20, 2009.

FIELD OF THE INVENTION

The present invention relates to a sheet processing device including an aligning unit that aligns edges of sheets discharged into a tray, an image forming apparatus including the sheet processing device, and an image forming system.

DESCRIPTION OF THE RELATED ART

A post-processing apparatus that has a function for aligning recording media is typically included in or connected to a higher-level device, such as an image forming apparatus, in order to perform post processing on the recording media that are discharged from the higher-level device.

For example, the sheet-shaped recording media (hereinafter, "sheets") are usually stacked in a tray after being discharged from a discharging unit that is included in such devices as a punching unit that punches sheets on which an image is formed, a stapling unit, a sheet post-processing apparatus that performs post processing such as imprinting, and an image forming apparatus that includes the sheet post-processing apparatus. The sheets stacked on the tray are automatically aligned for later use. There is a problem in that the degree of sheet alignment is not always adequate.

Japanese Patent No. 3973836 discloses an apparatus that includes an aligning unit in which a pair of aligning members is arranged. The aligning unit has an aligning function for aligning sheets, which are discharged from a discharging unit and stacked in a tray, only at a fixed position in the direction orthogonal to the sheet discharging direction and a sorting-and-aligning function for aligning the sheets in sets at a different position other than the fixed position in the direction orthogonal to the sheet discharging direction.

Japanese Patent Application Laid-open No. 2003-312930 discloses an apparatus used as a sheet aligning unit. The apparatus aligns both sides of the sheets in the width direction, which is the direction orthogonal to the sheet discharging direction, using a pair of aligning units (joggers) and aligns the leading edges of the sheets in the sheet discharging direction using a leading-edge aligning unit (stopper).

In the technologies disclosed in Japanese Patent No. 3973836 and Japanese Patent Application Laid-open No. 2003-312930, the aligning unit that aligns both sides of the sheets in the direction orthogonal to the sheet discharging direction generally reciprocates only in the width direction of the sheets. When a sheet is shifted, the aligning unit aligns only one side of the shifted sheet, which causes a problem in that sheet alignment cannot be performed with high accuracy.

Because the aligning unit is located near the discharging unit, when aligning a large size sheet, such as an A3 size sheet, the aligning unit sometimes cannot align the leading edges of the discharged sheets even though the aligning unit can align the discharged sheets that are near the aligning unit.

SUMMARY OF THE INVENTION

It is an object of the present invention to at least partially solve the problems in the conventional technology.

According to one aspect of the present invention, there is provided a sheet processing device including a shifting unit that shifts a plurality of sheets discharged on a tray to a different position in a sheet width direction that is perpendicular to a sheet discharging direction in a set of sheets; a first width-direction aligning unit and a second width-direction aligning unit each aligning both sides of the sheets in the sheet width direction; and a leading-edge aligning unit that aligns leading edges of the sheets in the sheet discharging direction.

Furthermore, according to another aspect of the present invention, there is provided an image forming apparatus including a sheet processing device that includes a shifting unit that shifts a plurality of sheets discharged on a tray to a different position in a sheet width direction that is perpendicular to a sheet discharging direction in a set of sheets, a first width-direction aligning unit and a second width-direction aligning unit each aligning both sides of the sheets in the sheet width direction, and a leading-edge aligning unit that aligns leading edges of the sheets in the sheet discharging direction.

Moreover, according to still another aspect of the present invention, there is provided an image forming system including a sheet processing device that includes a shifting unit that shifts a plurality of sheets discharged on a tray to a different position in a sheet width direction that is perpendicular to a sheet discharging direction in a set of sheets, a first width-direction aligning unit and a second width-direction aligning unit each aligning both sides of the sheets in the sheet width direction, and a leading-edge aligning unit that aligns leading edges of the sheets in the sheet discharging direction; and an image forming apparatus that is connected to the sheet processing device and that discharges a sheet to the sheet processing device.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
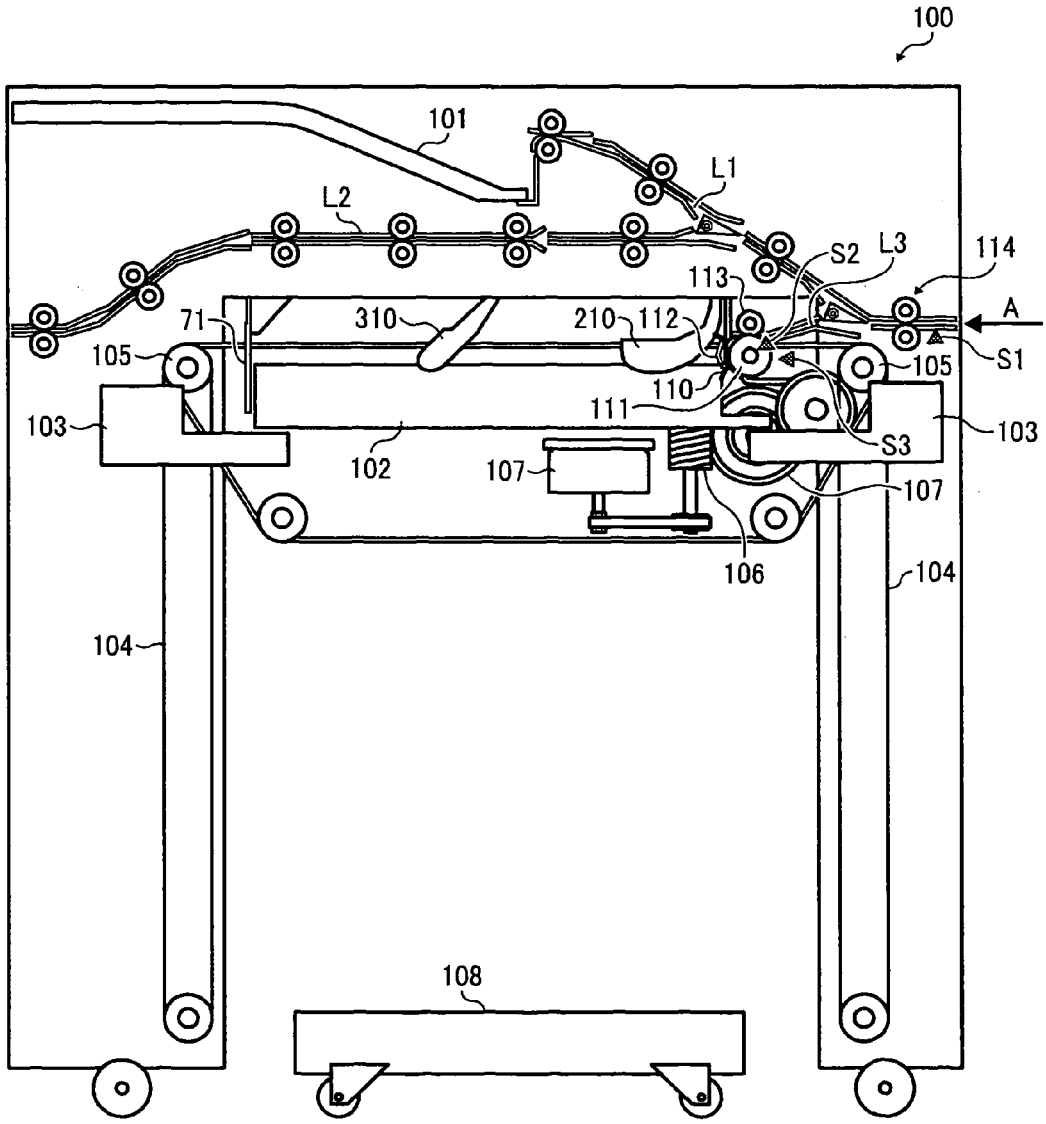
FIG. 1 is a schematic diagram of an internal structure of a stacker according to an embodiment of the present invention.

FIG. 1 is a schematic diagram of an internal structure of a stacker 100 according to an embodiment of the present invention. The stacker main body 100 receives sheets, which is a recording medium, discharged from a higher-level device, such as a copying machine (not shown), from the direction indicated by an arrow A. With the stacker 100, total three modes can be selected: a proof-discharging mode, a straight-discharging mode, and a shift-discharging mode.

The proof-discharging mode is an operating mode in which the sheets are guided to a proof tray 101 via a sheet conveying path L1 and stacked onto the proof tray 101. The straight-discharging mode is an operating mode in which the sheets are guided to a post-processing apparatus such as another stacker arranged downstream of the stacker 100 via a sheet conveying path L2. The shift-discharging mode is an operating mode in which the sheets are discharged into a shift tray 102 via a sheet conveying path L3. In the shift-discharging mode, the sheets are stacked at different shift positions in the shift tray 102.

The shift tray 102 is mounted on an elevator 103 that can be raised and lowered. Four corners of the elevator 103 are suspended with four timing belts 104 (only two timing belts 104 are shown in FIG. 1). Each of the timing belts 104 is wound around a corresponding timing pulley 105 (total four timing pulleys 105 are arranged, but only two pulleys are shown in FIG. 1). The timing pulleys 105 are coupled to a worm gear 106*a* and a gear train 106*b* formed of a plurality of gears and rotated by a driving force of a tray elevating motor 107 in synchronization with rotation of the worm gear 106*a* and the gear train 106*b*, thereby raising and lowering the elevator 103 together with the shift tray 102.

Because a power transmission system is arranged via the worm gear 106*a*, the shift tray 102 can be maintained at a home position. When the elevator 103 goes down to the lowest position, the sheets stacked in the shift tray 102 can be taken out together with the shift tray 102 by a carriage 108 by placing the shift tray 102 on the carriage 108.

A puddle 110 shown in FIG. 1 rotates in synchronization with a pair of discharging rollers 111 arranged on the sheet conveying path L3 and downwardly presses a trailing edge of the sheet discharged into the shift tray 102. The sheets stacked in the shift tray 102 push up a filler 112, and an optical type of a sheet sensor S3 detects a height of the sheet surface stacked in the shift tray 102 based on the movement of the filler 112.

When the sheet sensor S3 is ON, the tray elevating motor 107 lowers the shift tray 102. After the sheet sensor S3 is OFF, the tray elevating motor 107 stops. Accordingly, the shift tray 102 is lowered by a predetermined distance every time when the sheet sensor S3 is ON caused by the sheets stacked in the shift tray 102.

A sheet-path sensor S1 is arranged at an inlet of the sheet to be conveyed and detects the sheet passing the sheet-path sensor S1. Another sheet-path sensor S2 detects the sheet passing the sheet conveying path L3.

A pair of driven rollers 113 is in press contact with the discharging rollers 111 with a spring (not shown). The sheet is nipped between the discharging rollers 111 and the driven rollers 113 and conveyed. A pair of inlet rollers 114 carries the sheet discharged from the higher-level device into the stacker main body 100.

Figure 2:
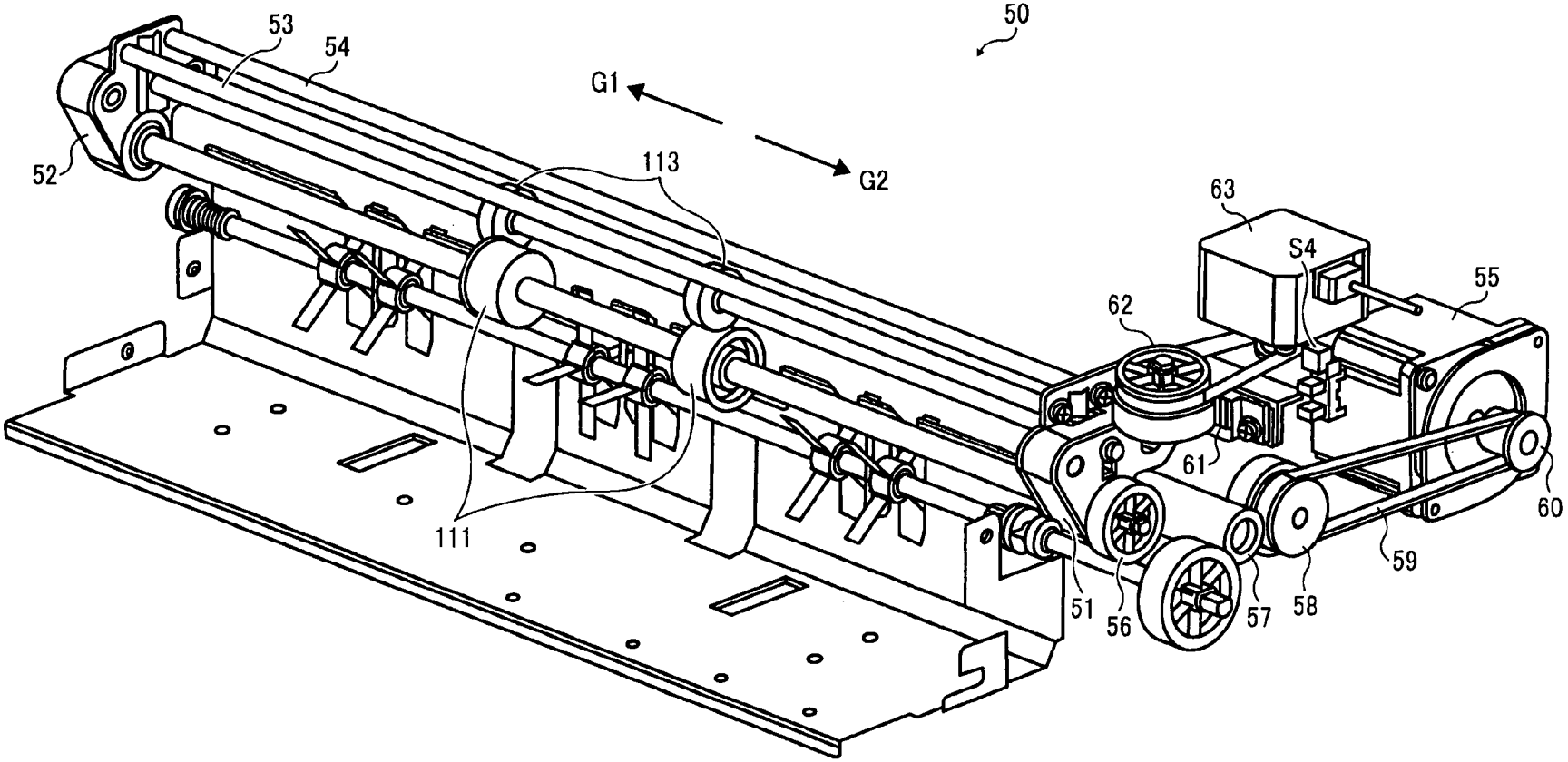
FIG. 2 is a perspective view of a shift conveying mechanism according to the embodiment.

FIG. 2 is a perspective view of a shift conveying mechanism 50 according to the embodiment. The shift conveying mechanism 50 functions as a shifting unit. By moving the discharging rollers 111 and the driven rollers 113 by a predetermined amount in the direction indicated by arrows in FIG. 2 (an arrow G1 represents a distal side of the stacker main body 100, and an arrow G2 represents a proximal side of the stacker main body 100), the shift conveying mechanism 50 shifts a position of the sheet discharged into the shift tray 102 to the distal side or proximal side of the stacker main body 100.

The discharging rollers 111 and the driven rollers 113 are arranged together with holders 51 and 52 that move in the directions of arrows G1 and G2 and shafts 53 and 54 that link the holders 51 and 52. A stepping motor 55 rotates the discharging rollers 111, regardless of moving positions in the directions of the arrows G1 and G2. Specifically, a driven gear 56 attached to the holder 51 is engaged with a drive gear 60 that is rotated by the stepping motor 55 via gears 57 and 58 and a belt 59, regardless of the moving position of the discharging rollers 111 in the directions of the arrows G1 and G2.

A rack gear 61 is arranged at the holder 51 and coupled to a shift motor 63 via a pinion 62. The discharging rollers 111 and the driven rollers 113 are slid by a predetermined amount (10 millimeters) in the directions of arrows G1 and G2, with a position indicated in FIG. 2 as the center position. A home position of the discharging roller 111 and the driven roller 113 is set at the center in the axial direction of the shafts 53 and 54, and an optical home-position sensor S4 detects the home position. The discharging rollers 111 and the driven rollers 113 are moved to shift positions with a rotation of the shift motor 63 by a predetermined amount based on the home position.

Figure 3:
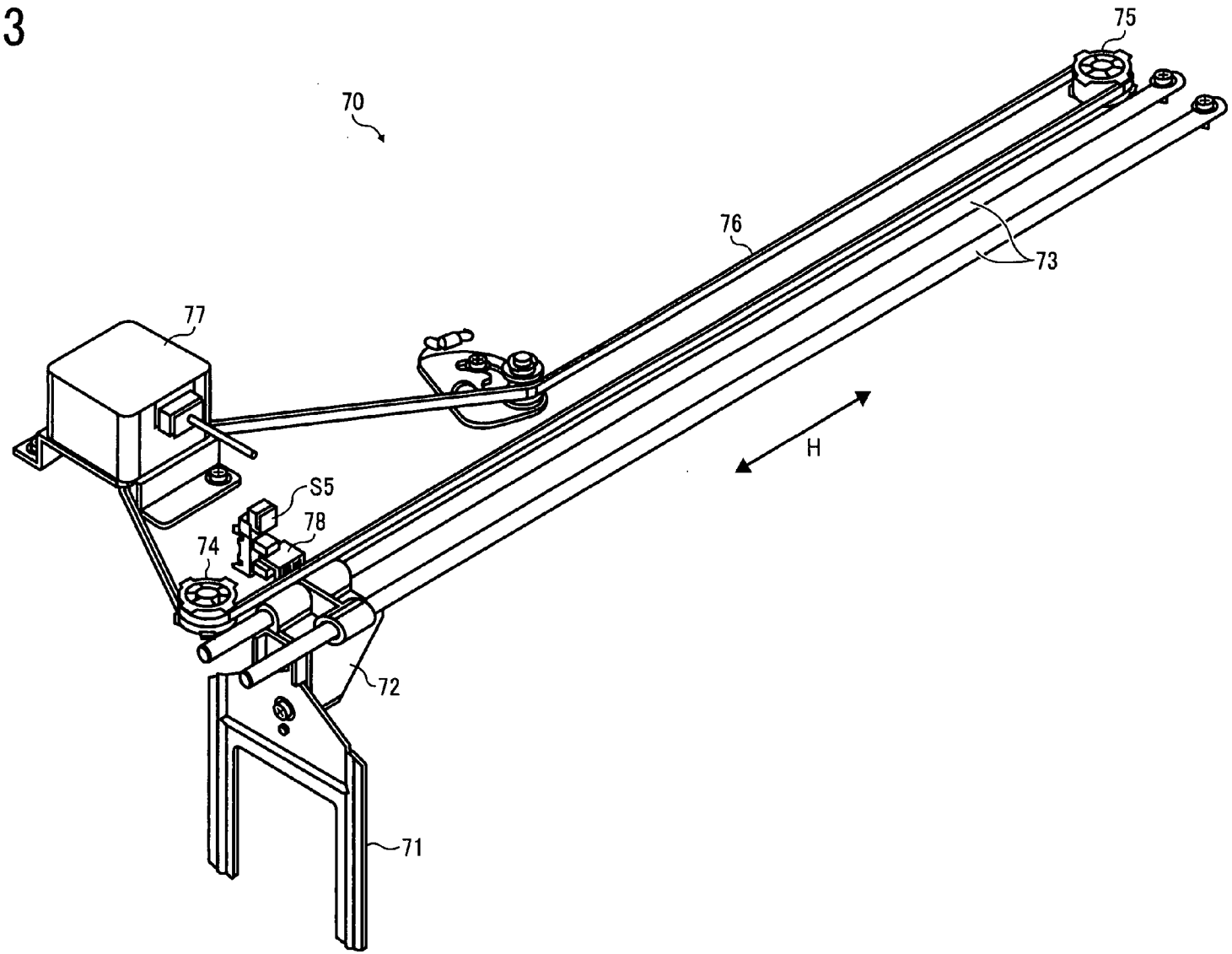
FIG. 3 is a perspective view of a leading-edge aligning mechanism according to the embodiment.

FIG. 3 is a perspective view of a leading-edge aligning mechanism 70 according to the embodiment. The leading-edge aligning mechanism 70, serving as a leading-edge aligning unit, aligns a leading edge of the sheet discharged into the shift tray 102 and includes a stopper 71 capable of positional alignment in the directions indicated by arrows H.

The stopper 71, serving as a leading-edge aligning member, is attached to a slider 72. The slider 72 is guided to shafts 73, in a slidable manner, that serves as a support shaft extending to the directions of the arrows H. The slider 72 is coupled to a belt 76 wound around a pair of pulleys 74 and 75. Because a motor 77 serving as a leading-edge aligning-member driving unit moves the belt 76, the slider 72 moves in the directions of the arrows H together with the stopper 71 and the leading edge of the sheet is aligned.

The slider 72 includes a shielding plate 78. An optical home position sensor S5 detects the shielding plate 78 when the stopper 71 moves to the home position.

Figure 4:
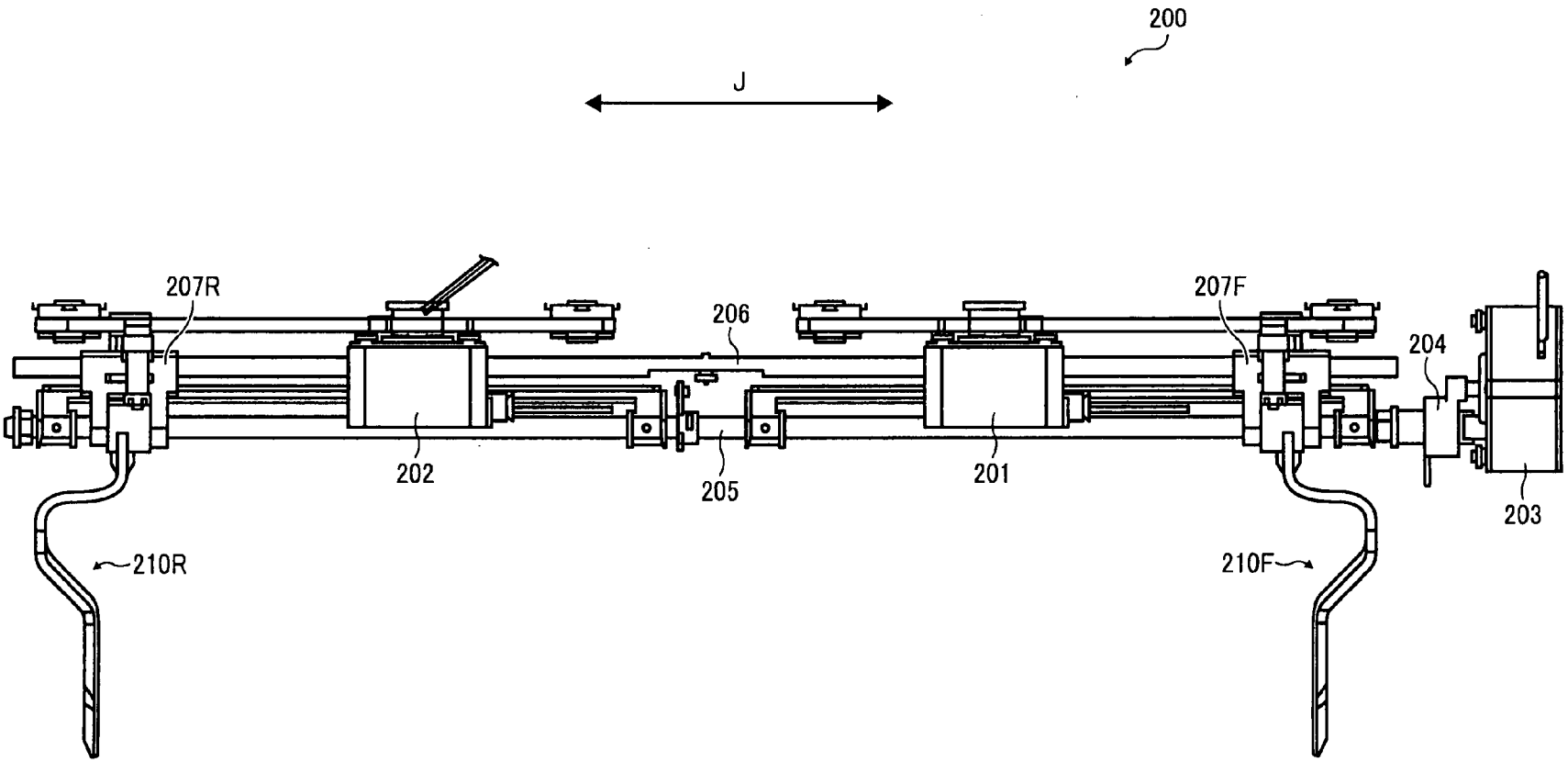
FIG. 4 is a front view of a main-jogger mechanism serving as a first width-direction aligning unit according to the embodiment.
Figure 5:
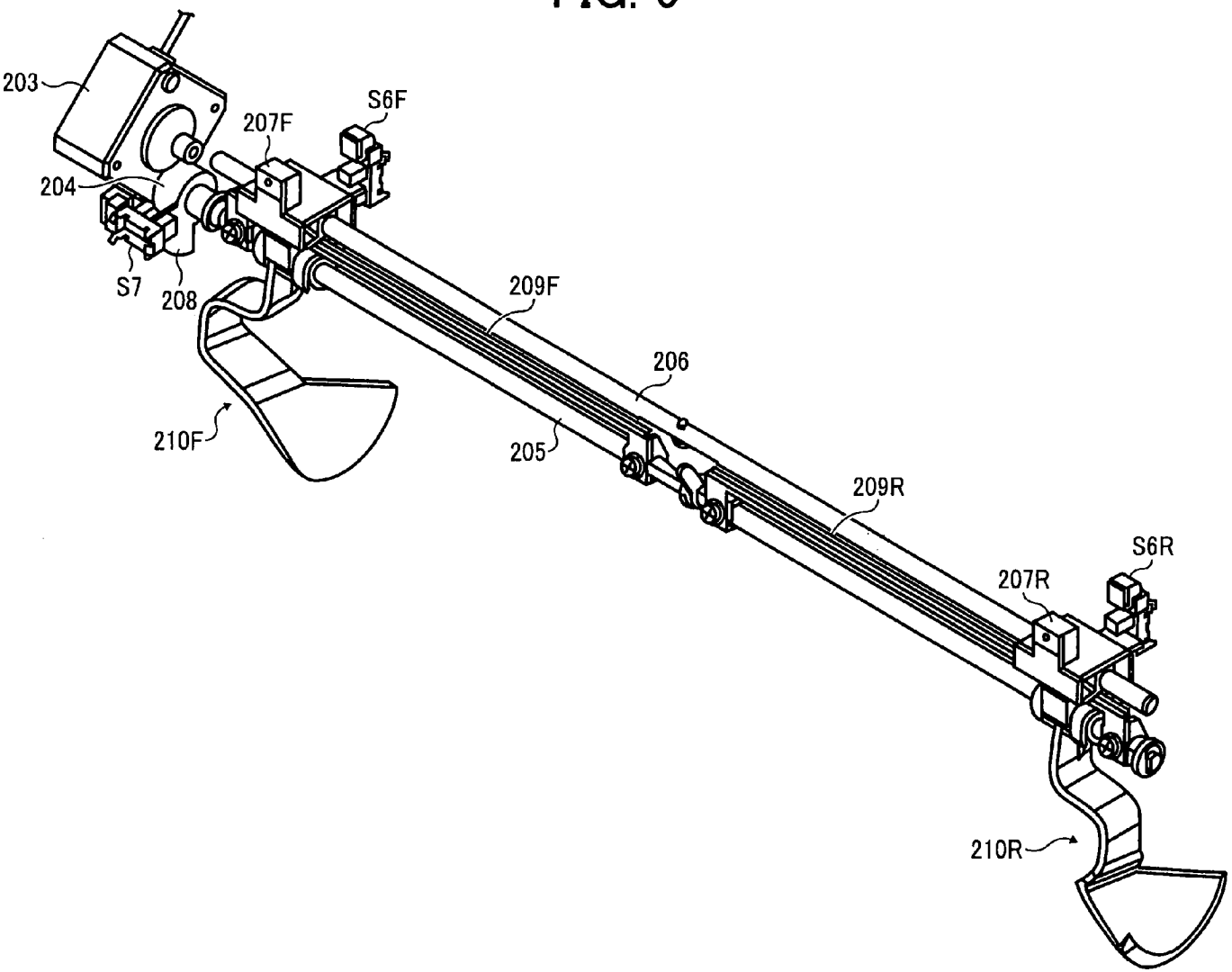
FIG. 5 is a perspective view of a main part of the main-jogger mechanism according to the embodiment.
Figure 6:
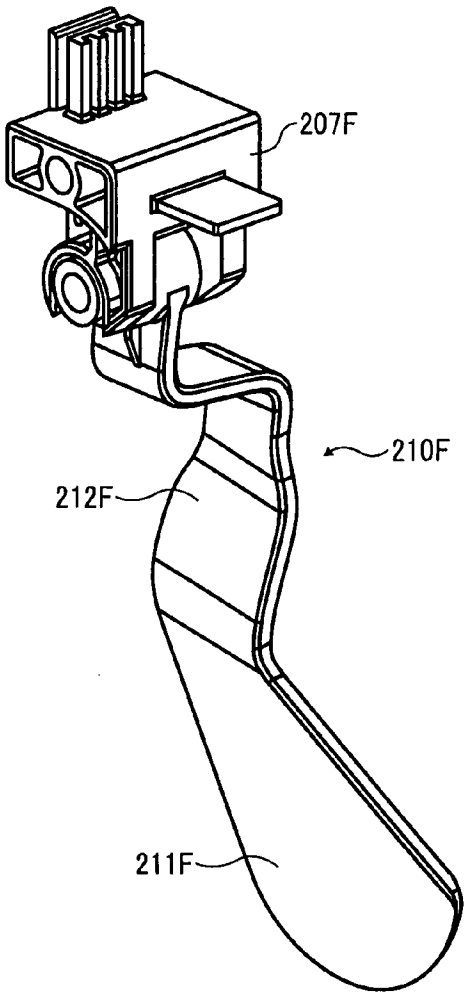
FIG. 6 is a perspective view of a pair of main joggers according to the embodiment.
Figure 6:
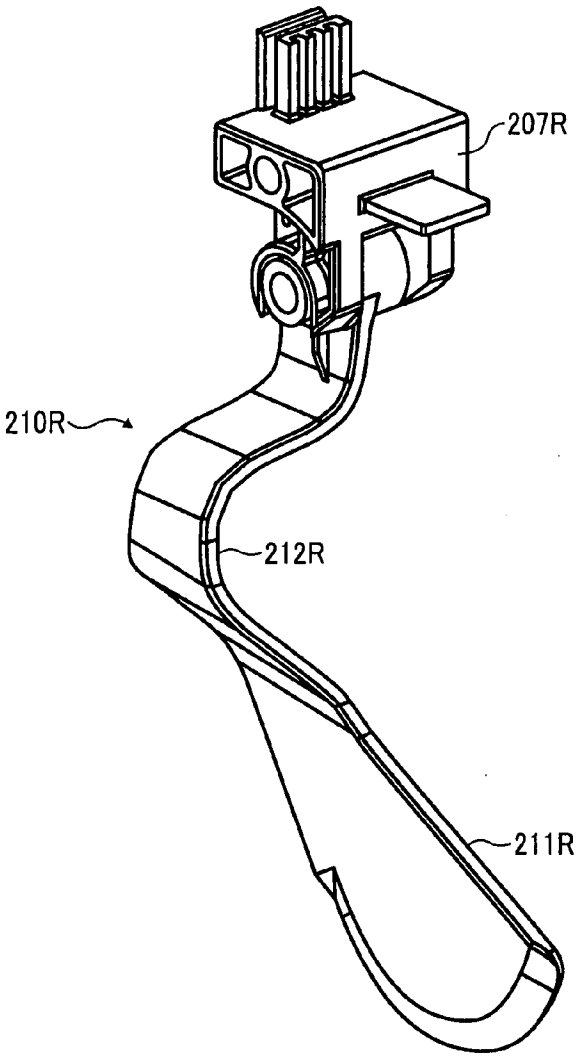

FIGS. 4 to 6 are schematic diagrams of a main-jogger mechanism 200 according to the embodiment, serving as a first width-direction aligning unit. FIG. 4 is a front view of the main-jogger mechanism 200, FIG. 5 is a perspective view of the main part of the main-jogger mechanism 200, and FIG. 6 is a perspective view of a pair of main joggers 210F and 210R.

In FIG. 4, the main-jogger mechanism 200 includes an aligning-member driving unit that includes stepping motors 201 and 202; a stepping motor 203; a gear 204; a rotation shaft 205; and a driving shaft 206. The stepping motors 201 and 202 control the movement in the width direction of the sheet directions indicated by arrows J that are orthogonal to the sheet discharging direction on the sheet surface. The stepping motor 203 serves as a retracting unit that controls the movement upward and downward. The gear 204 is engaged with an output gear of the stepping motor 203. The rotation shaft 205 serves as a support shaft and to which the gear 204 is attached. The driving shaft 206 is arranged parallel to the rotation shaft 205.

As shown in FIG. 5, the main-jogger mechanism 200 includes a pair of opposing sliders 207F and 207R that is coupled to the driving shaft 206; sensors S6F and S6R shown in FIG. 5 that detect the sliders 207F and 207R, respectively; a filler 208 arranged at the gear 204 that indicates rotation of the rotation shaft 205; a sensor S7 that detects the filler 208; and a pair of main joggers 210F and 210R that is arranged opposite each other. The main-jogger mechanism 200 controls the main joggers 210F and 210R in such a manner that a distance between the main joggers 210F and 210R becomes large and small and also controls the movement of the main joggers 210F and 210R upward and downward. A state in which the filler 208 is detected by the sensor S7 corresponds to the home position of the main joggers 210F and 210R, where the main joggers 210F and 210R are in a downward state.

As shown in FIG. 6, the main joggers 210F and 210R are formed of plate-shaped members. A pair of aligning portions 211F and 211R is arranged opposite each other and located at the lowest portion of the main joggers 210F and 210R, respectively. The opposing faces of the aligning units 211F and 211R are formed of flat surfaces that are orthogonal to the shift direction, i.e., the direction of the arrow J.

Because the aligning portions 211F and 211R are configured such that the opposing faces thereof are formed of the flat surfaces orthogonal to the shift direction, with a movement of the main joggers 210F and 210R in the shift direction, the aligning units 211F and 211R reliably move close to and away from both sides of the sheets in the width direction of the sheet stacked in the shift tray 102, thus aligning a set of sheets by holding the sheets.

The main joggers 210F and 210R have a pair of step-shaped escaping portions 212F and 212R at an upper portion of the aligning units 211F and 211R. The escaping portions 212F and 212R, which are arranged opposite each other, have a larger distance than that between the opposing aligning portions 211F and 211R to avoid interference with the sheet to be discharged when the sheet discharged from the discharging rollers 111 is guided into a distance between the opposing main joggers 210F and 210R. The distance between the opposing escaping portions 212F and 212R is set to be larger than the distance between the opposing aligning units 211F and 211R by an amount equal to or larger than a half of a distance in which the sheet shifts in the direction orthogonal to the sheet discharging direction.

The main joggers 210F and 210R are supported by sliders 207F and 207R in such a manner that base portions of the main joggers 210F and 210R are press fit into the sliders 207F and 207R. The main joggers 210F and 210R are configured such that they do not further hang down over a predetermined position depending on positions of the sliders 207F and 207R, whereas, the main joggers 210F and 210R are movable upward.

The main joggers 210F and 210R wait for the sheet discharged from the discharging rollers 111 by maintaining a predetermined distance capable of receiving the sheet.

Every time when the sheet is discharged from the discharging rollers 111 and stacked in the shift tray 102, the main joggers 210F and 210R narrow the distance at a receiving position where the main joggers 210F and 210R receive the sheet, move toward both sides of the sheet in the width direction of the sheet, and then return to the receiving position by increasing the distance between the opposing main joggers 210F and 210R. With this series of operations, the main joggers 210F and 210R align both sides of the sheet.

After the discharging rollers 111 discharge a predetermined number of sheets corresponding to a first set of sheets while repeatedly shifting the sheets in the direction of the arrow G1 by, for example, 10 millimeters for each sheet, the discharging rollers 111 subsequently stack up a subsequent set of sheets while repeatedly shifting the sheets in the direction of the arrow G2 by 10 millimeters. When the discharging rollers 111 change their shift positions, the main joggers 210F and 210R rotate and move to a retracted position, which causes the aligning member to be in a retracted state. The main joggers 210F and 210R perform the shift operation in this retracted state.

When the discharging rollers 111 shift to the main jogger 210F, the main jogger 210R is positioned at a distal side of the discharged sheet stacked in the shift tray 102 with respect to the sheet discharging direction and on a top sheet of the previous set of sheets (sheets in sets).

On the other hand, the main jogger 210F is positioned at a proximal side of the discharged sheet stacked in the shift tray 102 with respect to the sheet discharging direction, which is the home position of the main joggers 210 (i.e., 210F and 210R) in terms of upward and downward positions. Every time when the shift operation of the discharging rollers 111 is changed in an opposite direction, the rotation shaft 205 is rotated in a direction in which arms 209F and 209R attached to the rotation shaft 205 downwardly press the base portion of the main joggers 210F and 210R, which makes the main joggers 210F and 210R to move to the retracted position.

Every time the shift operation is performed, the other aligning member (the main jogger 210F or 210R) is made to be in contact with (placed on) the top sheet of the previous set of sheets, thus aligning the set of discharged sheets. The sheets can be aligned in a stable manner by forming the main joggers 210F and 210R made of a material having a coefficient of friction high enough that the sheets is not shifted caused by the main joggers 210F and 210R.

The main joggers 210F and 210R rotate with a moment by gravity and are positioned at an aligning operating position where the main joggers 210F and 210R come into contact with a top face of the shift tray 102 or the top sheet stacked in the shift tray 102.

A retract amount of the main joggers 210F and 210R corresponds to a retract amount of the main joggers 210F and 210R retracting form the home position where the sensor S7 detects the filler 208; therefore, an increasing amount is always constant. Without making the main joggers 210F and 210R to move (raise) by an amount of "from the home position to the top sheet of the set of discharged sheets+$\alpha$", the set of stacked sheets that is shifting toward the main joggers 210F or 210R interferes with (contact with) the main joggers 210F or 210R, which causes the aligned set of sheets to collapse.

The amount of "+$\alpha$" corresponds to a distance between the home position and a certain position up to the top sheet. If an amount of $\alpha$ is large, an amount of margin capable of coping with curled or folded sheets increases; however, when an interval for receiving a first sheet and a second sheet is small, a long reset time is required for receiving a third sheet.

Figure 7:
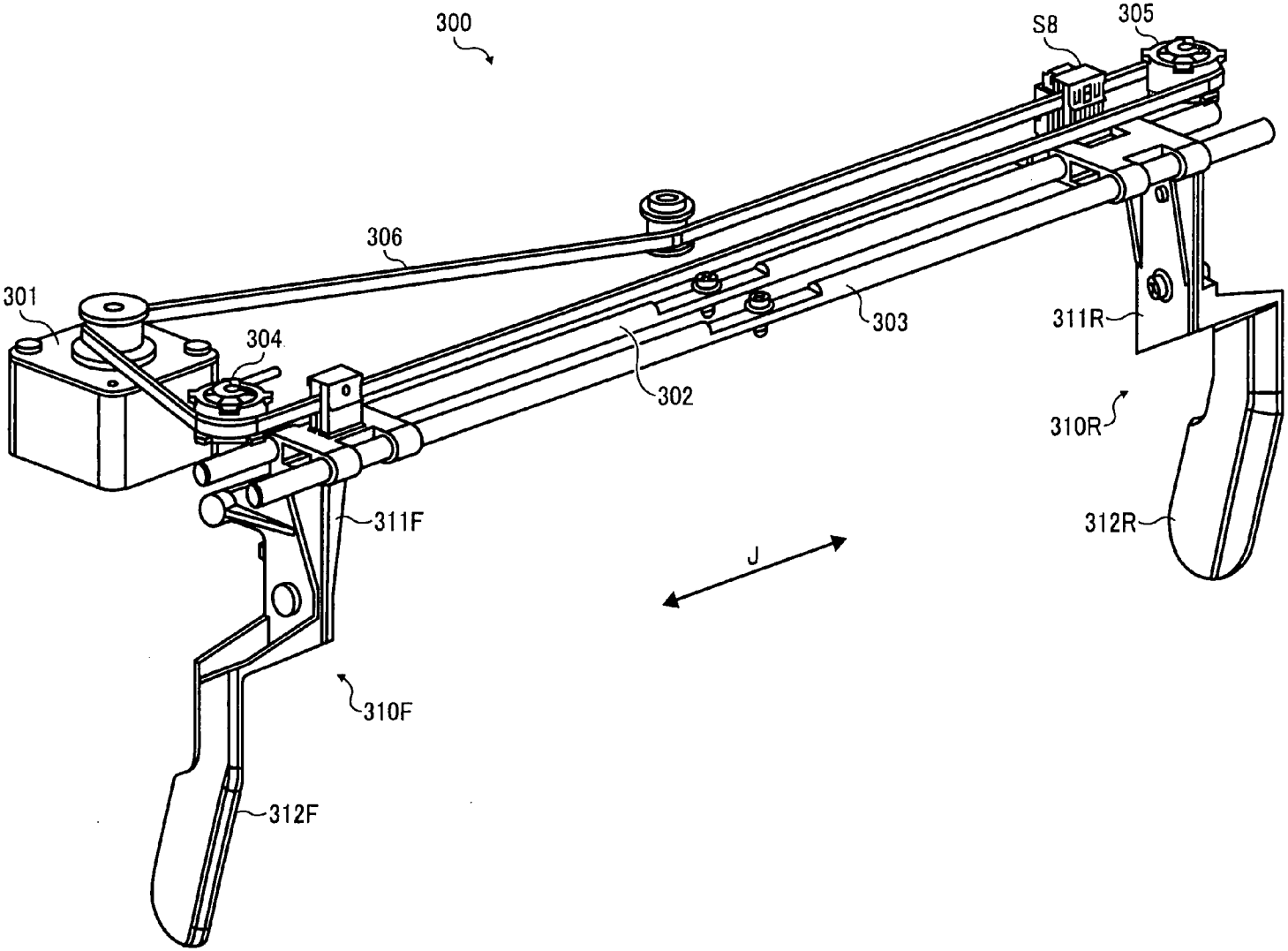
FIG. 7 is a perspective view of a sub-jogger mechanism serving as a second width-direction aligning unit according to the embodiment.

FIG. 7 is a perspective view of a sub-jogger mechanism 300 according to the embodiment serving as a second width-direction aligning unit. The sub-jogger mechanism 300 aligns both sides of the leading edge of the sheet discharged into the shift tray 102. A pair of sub joggers 310F and 310R is arranged opposite each other, in a positional adjustable manner by a stepping motor 301 in a width direction of the sheet (directions of the arrows J). As shown in FIG. 1, the sub joggers 310F and 310R are located downstream of the main joggers 210F and 210R with respect to the sheet discharging direction.

The sub joggers 310F and 310R are formed of plate-shaped members and include a pair of aligning portions 312F and 312R. The sub joggers 310F and 310R are arranged opposite each other, and the opposing faces thereof are formed of flat surfaces orthogonal to the shift direction of the sheet. The sub joggers 310F and 310R are attached to a pair of sliders 311F and 311R. The sliders 311F and 311R are guided by a set of shafts 302 and 303, in a slidable manner, that serves as a support shaft extending to the directions of the width direction of the sheet indicated by the arrows J. The sliders 311F and 311R are coupled to a belt 306 wound around a pair of pulleys 304 and 305.

Because the stepping motor 301 moves the belt 306, the sliders 311F and 311R move in the width direction together with the sub joggers 310F and 310R. An optical home position sensor S8 detects the slider 311R when the slider 311R moves to a home position.

The positions of the sub joggers 310F and 310R are adjusted such that the sub joggers 310F and 310R align one side of the shifted sheet and wait for the sheet at a position where a distance between the opposing sub joggers 310F and 310R corresponds to a sum of the sheet width and the shift amount of the sheet (hereinafter, "shift position"). Furthermore, the positions of the sub joggers 310F and 310R are adjusted such that the distance between the opposing sub joggers 310F and 310R is widened at the same time as the sheet is shifted, and return to the shift position before the trailing edge of the sheet is discharged. The positions of the sub joggers 310F and 310R are adjusted such that the sub joggers 310F and 310R align the sheets only when the leading edge of the sheet is located downstream of the sub joggers 310F and 310R, at a timing when the distance between the opposing sub joggers 310F and 310R return to the shift position. The positional adjustment of the sub joggers 310F and 310R performed in this way makes it possible to prevent the leading edge of the discharged sheet from being abut against the sub joggers 310F and 310R.

In the above examples, there is a case in which the stacker, used as the sheet post-processing apparatus, is connected to an image forming apparatus, such as a copying machine and a printer, that is the higher-level device and constructs an image forming system, or the stacker is built in or arranged at the sheet discharging unit of the image forming apparatus. In either case, it is possible to implement sheet discharging processing in a highly reliable manner.

According to one aspect of the present invention, a sheet alignment can be accurately performed as a whole because a sheet processing device can shift sheets in a tray in the width direction of the sheet, and aligning units can reliably align both sides of the sheets in the width direction and leading edges of the sheets in the sheet discharging direction regardless of a sheet size.

Furthermore, according to another aspect of the present invention, a sheet alignment can be accurately performed when the sheets are discharged, thus implementing highly reliable image forming apparatus and image forming system.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing device, comprising:

a first width-direction aligning unit and a second width-direction aligning unit each aligning both sides of sheets discharged on a tray in a sheet width direction that is perpendicular to a sheet discharging direction, wherein:

the first width-direction aligning unit is arranged near a portion where the sheets are discharged, and the second width-direction aligning unit is arranged downstream of the first width-direction aligning unit in the sheet discharging direction.

2. The sheet processing device according to claim 1, wherein each of the first width-direction aligning unit and the second width-direction aligning unit includes a pair of aligning members arranged opposite each other, and an aligning-member driving unit that drives the aligning members, and the aligning members include a pair of aligning portions abut both sides of the sheets in a direction parallel to the sheet discharging direction.

3. The sheet processing device according to claim 1, wherein the first width-direction aligning unit includes a pair of step-shaped escaping portions arranged opposite each other at an upper portion of the aligning portions with a first distance between the escaping portions larger than a second distance between the aligning portions.

4. The sheet processing device according to claim 3, wherein a difference between the first distance and the second distance is larger than a half of a distance in which the sheets shift in the sheet width direction.

5. The sheet processing device according to claim 1, wherein the first width-direction aligning unit reciprocates in the sheet width direction for each of the sheets.

6. The sheet processing device according to claim 2, wherein the first width-direction aligning unit further includes a support shaft that rotatably supports the aligning members, and a retracting unit that retracts the aligning members from an aligning operating position to a retract position by rotating the aligning members.

7. The sheet processing device according to claim 2, wherein the aligning members of the first width-direction aligning unit rotate with a moment by gravity and are arranged at an aligning operating position where a top surface of the tray or a top sheet of the sheets stacked in the tray comes into contact with the aligning operating position.

8. The sheet processing device according to claim 2, wherein the aligning portions of the first width-direction aligning unit are formed of a material having a coefficient of friction with which the sheets are not shifted when the aligning portions reciprocate in contact with a top sheet of the sheets stacked in the tray.

9. The sheet processing device according to claim 2, wherein the aligning members of the second width-direction aligning unit waits for the sheets at a position where a distance between the aligning members is a sum of a sheet width and a shift amount.

10. The sheet processing device according to claim 2, wherein the second width-direction aligning unit is configured such that a distance between the aligning members is widened at a same time as the sheets are shifted and return to a position where the distance is a sum of a sheet width and a shift amount before the trailing edges of the sheets are discharged.

11. The sheet processing device according to claim 10, wherein, at a timing when the distance between the aligning members returns to the position, the second width-direction aligning unit aligns the sheets exclusively when the leading edges of the sheets are located downstream of the second width-direction aligning unit.

12. An image forming apparatus, comprising:

a sheet processing device that includes a first width-direction aligning unit and a second width-direction aligning unit each aligning both sides of sheets discharged on a tray in a sheet width direction that is perpendicular to a sheet discharging direction, wherein:

the first width-direction aligning unit is arranged near a portion where the sheets are discharged, and the second width-direction aligning unit is arranged downstream of the first width-direction aligning unit in the sheet discharging direction.

13. An image forming system, comprising:

a sheet processing device that includes:

a first width-direction aligning unit and a second width-direction aligning unit each aligning both sides of sheets discharged on a tray in a sheet width direction that is perpendicular to a sheet discharging direction, wherein:

the first width-direction aligning unit is arranged near a portion where the sheets are discharged, and the second width-direction aligning unit is arranged downstream of the first width-direction aligning unit in the sheet discharging direction; and an image forming apparatus that is connected to the sheet processing device and that discharges a sheet to the sheet processing device.

* * * * *